US012649637B2

(12) United States Patent
Namiki et al.

(10) Patent No.: US 12,649,637 B2
(45) Date of Patent: Jun. 9, 2026

(54) MEDIUM TRANSPORT DEVICE AND IMAGE READING APPARATUS

(71) Applicant: SEIKO EPSON CORPORATION, Tokyo (JP)

(72) Inventors: Masaki Namiki, Kitakyushu (JP); Yuhei Hamada, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 18/435,435

(22) Filed: Feb. 7, 2024

(65) Prior Publication Data

US 2024/0270526 A1 Aug. 15, 2024

(30) Foreign Application Priority Data

Feb. 10, 2023 (JP) ..... 2023-018876

(51) Int. Cl.
*B65H 9/00* (2006.01)
*B65H 5/06* (2006.01)

(52) U.S. Cl.
CPC ..... *B65H 9/004* (2013.01); *B65H 5/062* (2013.01); *B65H 2301/31* (2013.01); *B65H 2301/544* (2013.01); *B65H 2403/50* (2013.01); *B65H 2551/21* (2013.01); *B65H 2701/112* (2013.01)

(58) Field of Classification Search
CPC .... B65H 3/66; B65H 5/36; B65H 2404/6112; B65H 2404/64; B65H 2404/693; B65H 2404/741; B65H 2404/7412; B65H 2511/13
See application file for complete search history.

(56) References Cited

U.S. PATENT DOCUMENTS

| | | | | |
|---|---|---|---|---|
| 7,920,819 | B2 * | 4/2011 | Miyake | G03G 15/2028 399/45 |
| 8,929,801 | B2 * | 1/2015 | Ozawa | G03G 15/6552 399/405 |
| 11,161,356 | B2 * | 11/2021 | Kodama | B65H 9/006 |
| 11,203,498 | B2 * | 12/2021 | Fukumasu | B65H 3/0607 |
| 12,187,569 | B2 * | 1/2025 | Itozaki | B65H 29/58 |
| 2015/0281499 | A1 | 10/2015 | Hamaguchi | |
| 2024/0317538 | A1 * | 9/2024 | Shimosaka | B65H 29/125 |

FOREIGN PATENT DOCUMENTS

JP 2015-195475 A 11/2015

* cited by examiner

*Primary Examiner* — Michael McCullough
(74) *Attorney, Agent, or Firm* — WORKMAN NYDEGGER

(57) ABSTRACT

A medium transport device includes a drive source, a transport path through which a medium is transported in a transport direction between a first path surface and a second path surface located away from the first path surface, a plurality of projecting portions that projects from the first path surface and is arranged in a width direction intersecting the transport direction, and a moving portion that changes a projecting amount of the projecting portions with respect to the first path surface by power of the drive source between the first path surface and the second path surface.

15 Claims, 10 Drawing Sheets

MEDIUM TRANSPORT DEVICE AND IMAGE READING APPARATUS

The present application is based on, and claims priority from JP Application Serial Number 2023-018876, filed Feb. 10, 2023, the disclosure of which is hereby incorporated by reference herein in its entirety.

BACKGROUND

1. Technical Field

The present disclosure relates to a medium transport device and an image reading apparatus.

2. Related Art

Examples of an apparatus of this type include the apparatus described in JP-A-2015-195475. In JP-A-2015-195475, FIGS. 4 to 6 and the description corresponding thereto in the specification disclose a conveyance path provided with a plurality of ribs.

The apparatus described in JP-A-2015-195475 has room for improvement in terms of stably transporting a medium through the conveyance path according to the difference in thickness of the medium.

SUMMARY

To solve the above-described problem, the present disclosure is a medium transport device including a drive source, a transport path through which a medium is transported in a transport direction between a first path surface and a second path surface located away from the first path surface, a plurality of projecting portions that projects from the first path surface and is arranged in a width direction intersecting the transport direction, and a moving portion that changes a projecting amount of the projecting portions with respect to the first path surface by power of the drive source between the first path surface and the second path surface.

In addition, the present disclosure is an image reading apparatus including the medium transport device according to any one of the first to the twelfth aspects described later, and a reading unit that is located downstream of the projecting portions in the transport direction and reads a medium transported.

DESCRIPTION OF EMBODIMENTS

Figure 1:
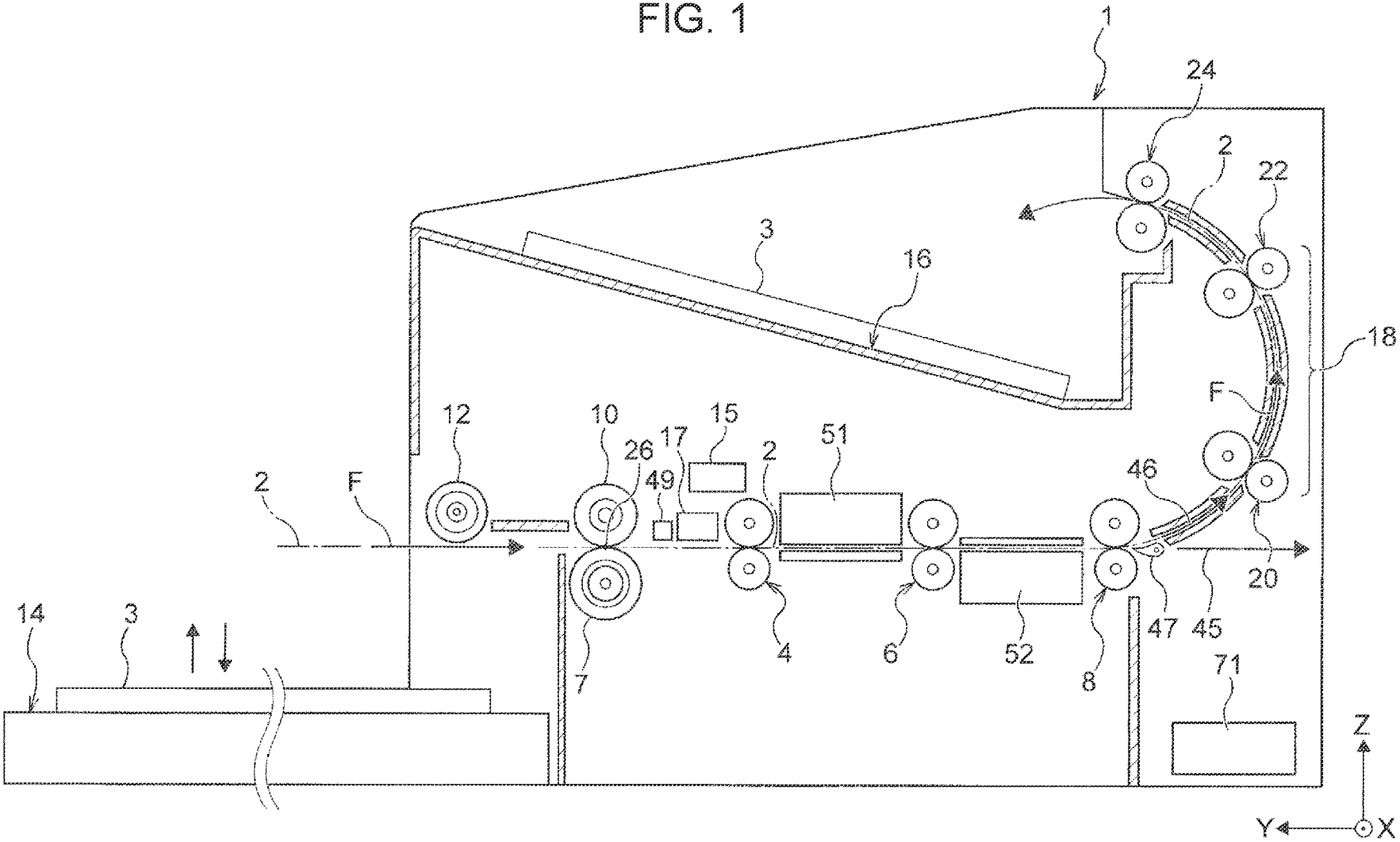
FIG. 1 is a schematic configuration view illustrating a main portion inside of an image reading apparatus according to Embodiment 1 in a side view.

Hereinafter, first, the present disclosure will be schematically described. To solve the above-described problem, a first aspect of the present disclosure is a medium transport device including a drive source, a transport path through which a medium is transported in a transport direction between a first path surface and a second path surface located away from the first path surface, a plurality of projecting portions that projects from the first path surface and is arranged in a width direction intersecting the transport direction, and a moving portion that changes a projecting amount of the projecting portions with respect to the first path surface by power of the drive source between the first path surface and the second path surface.

According to this aspect, a plurality of projecting portions that projects from the first path surface and is arranged in a width direction intersecting the transport direction is included, and the projecting portions can change the projecting amount with respect to the first path surface. As a result, even for a medium having a different thickness, the projecting amount is adjusted according to the thickness, and thus the medium can be stably transported.

A second aspect of the present disclosure is the medium transport device according to the first aspect, in which the projecting portions are fixed at least at two positions in a projecting direction. In other words, the projecting portions are configured to be rigidly fixed at two positions, which are a first position and a second position, in the projecting direction, not by the balance of elastic force.

According to this aspect, the projecting portions are fixed at least at two positions in the projecting direction. In other words, the projecting portions are in two positions, which are a first position and a second position that is different from the first position in the projecting direction, and are rigidly fixed, not by a balanced state of elastic force. As a result, a medium having a different thickness can be stably transported.

A third aspect of the present disclosure is the medium transport device according to the first aspect, in which the moving portion includes an abutting portion configured to abut against the projecting portions, the projecting portions include a plurality of projections provided in a width direction intersecting the transport direction, a supporting portion that supports the projections, and an abutted portion against which the abutting portion abuts, and at least part of the moving portion overlaps the drive source when viewed in the transport direction. Note that this aspect can also be made dependent on the second aspect.

According to this aspect, the moving portion includes the abutting portion, and the projecting portions include the plurality of projections, the supporting portion that supports the projections, and the abutted portion against which the abutting portion abuts. As a result, the projecting portions can be in the first position and the second position with a simple structure. In addition, since at least part of the moving portion overlaps the drive source when viewed in the transport direction, an increase in size of the device in a direction intersecting the transport direction can be suppressed.

A fourth aspect of the present disclosure is the medium transport device according to the third aspect, further including a transport roller that transports the medium, in which the transport roller has a region where at least five projections are disposed, the region being inside both end portions of the transport roller.

According to this aspect, in the region inside both end portions of the transport roller, at least five projections are disposed. As a result, even a medium having a minimum width size that can be transported such as a business form, a plastic card, and a business card can be stably transported.

A fifth aspect of the present disclosure is the medium transport device according to the third aspect, further including a transport roller that transports the medium, in which the projections include a first projection having a first length and a second projection having a second length that is longer than the first length in the transport direction, and part of the second projection overlaps the transport roller when viewed in a rotation axis direction of the transport roller. Note that this aspect can also be made dependent on the fourth aspect.

According to this aspect, the projections include a first projection having a first length and a second projection having a second length that is longer than the first length in the transport direction, and part of the second projection overlaps the transport roller when viewed in a rotation axis direction of the transport roller. As a result, an increase in size of the entire device in the transport direction can be suppressed.

A sixth aspect of the present disclosure is the medium transport device according to the third aspect, in which the respective projections include an inclined surface that guides a leading end of the medium at an upstream position of a leading end surface in the transport direction, the leading end surface facing the second path surface, and when the projections are moved further in a direction of increasing the projecting amount, the inclined surface is exposed more. Note that this aspect can also be made dependent on the fourth or the fifth aspect.

According to this aspect, the respective projections include the inclined surface that guides a leading end of the medium at an upstream position of a leading end surface in the transport direction, the leading end surface facing the second path surface, and when the projections are moved further in a direction of increasing the projecting amount, the inclined surface is exposed more. As a result, since a leading end of a medium having a different thickness can be guided in the same manner, medium transporting performance can be stabilized.

A seventh aspect of the present disclosure is the medium transport device according to the third aspect, in which the abutting portion includes a first abutting portion and a second abutting portion, the abutted portion includes a first abutted portion and a second abutted portion, and the first abutting portion and the first abutted portion are provided opposite the second abutting portion and the second abutted portion with respect to a reference position in the width direction. Note that this aspect can also be made dependent on any one of the fourth to the sixth aspects.

According to this aspect, the first abutting portion and the first abutted portion are disposed opposite the second abutting portion and the second abutted portion with respect to a reference position in the width direction. As a result, the entire projecting portions can be stably moved.

An eighth aspect of the present disclosure is the medium transport device according to the second aspect, further including a first path through which the medium is transported in the transport direction without being curved and reversed, a second path through which the medium is curved and reversed, and transported in the transport direction, and a switching unit that switches between the first path and the second path, in which when the respective projecting portions are at a position of transporting a first medium, the switching unit is switched to a position where the first medium is configured to be transported through the second path, and when the respective projecting portions are at a position of transporting a second medium thicker than the first medium, the switching unit is switched to a position where the second medium is configured to be transported through the first path. Note that this aspect can also be made dependent on any one of the third to the seventh aspects.

According to this aspect, when the respective projecting portions are at a position of transporting the first medium, the switching unit is switched to a position where the first medium is configured to be transported through the second path, and when the respective projecting portions are at a position of transporting a second medium thicker than the first medium, the switching unit is switched to a position where the second medium is configured to be transported through the first path. As a result, since the transport path can be switched according to the difference in thickness of the medium, transport damage to the medium can be suppressed.

A ninth aspect of the present disclosure is the medium transport device according to the eighth aspect, further including a power transmission unit that transmits power of the drive source to the switching unit, in which when the drive source rotates in one direction, the respective projecting portions move to the position of transporting the first medium, and the switching unit is switched to the position where the first medium is configured to be transported through the second path, and when the drive source rotates in another direction, the respective projecting portions move to the position of transporting the second medium, and the switching unit is switched to the position where the second medium is configured to be transported through the first path.

According to this aspect, when power is transmitted from the drive source through the power transmission unit and the drive source rotates in one direction, the respective projecting portions move to the position of transporting the first medium, and the switching unit is switched to the position where the first medium is configured to be transported through the second path. In addition, when the drive source rotates in another direction, the respective projecting portions move to the position of transporting the second medium, and the switching unit is switched to the position where the second medium is configured to be transported through the first path. As a result, since operation of the projecting portions and operation of the switching unit can be performed while a motor as the drive source is not increased, size reduction can be realized.

A tenth aspect of the present disclosure is the medium transport device according to the ninth aspect, further including a switching gear disposed at a position, in the power transmission unit, of transmitting power to the switching unit, a pressing portion provided in the switching gear, and a pressed portion provided in the switching unit, in which at normal time, the switching unit is in the position where the first medium is configured to be transported through the second path, and when the second medium is transported, the switching unit is switched to the position where the second medium is configured to be transported through the first path after the power is transmitted to rotate the switching gear, and the pressed portion is pressed by the pressing portion and rotates.

According to this aspect, at normal time, the switching unit is in the position where the first medium is configured to be transported through the second path. In addition, when the second medium is transported, the switching unit is switched to the position where the second medium is configured to be transported through the first path after the power is transmitted to rotate the switching gear, and the pressed portion is pressed by the pressing portion and rotates. As a result, operation of the projecting portions and operation of the switching unit can be performed with a simple structure.

An eleventh aspect of the present disclosure is the medium transport device according to the eighth aspect, further including a separation unit that separates one sheet of a medium from the medium that is double-fed, and a medium thickness detection unit located between the separation unit and the switching unit in the transport direction, in which the medium thickness detection unit detects information on thickness of the medium separated by the separation unit, when a detection result of the medium thickness detection unit is equal to or more than a threshold, the switching unit is switched to a position where the medium is configured to be transported through the first path, and when the detection result of the medium thickness detection unit is less than the threshold, the switching unit is switched to a position where the medium is configured to be transported through the second path. Note that this aspect can also be made dependent on the ninth or the tenth aspect.

According to this aspect, when a detection result of the medium thickness detection unit is equal to or more than a threshold, the switching unit is switched to a position where the medium is configured to be transported through the first path, and when the detection result of the medium thickness detection unit is less than the threshold, the switching unit is switched to a position where the medium is configured to be transported through the second path. As a result, the transport path can be automatically switched according to the thickness of the medium.

A twelfth aspect of the present disclosure is the medium transport device according to the eleventh aspect, further including a control unit that controls the drive source, in which when "automatic" is selected as a type of the medium, in a case in which a detection result of the medium thickness detection unit does not correspond to a transport path, the control unit stops transporting of the medium, and resumes transporting after the transport path is switched.

According to this aspect, when "automatic" is selected as a type of the medium, in a case in which a detection result of the medium thickness detection unit does not correspond to a transport path, the control unit stops transporting of the medium, and resumes transporting after the transport path is switched. As a result, since the transport path can be automatically changed, user convenience is enhanced.

A thirteenth aspect of the present disclosure is an image reading apparatus including the medium transport device according to any one of the first to the twelfth aspects, and a reading unit that is located downstream of the projecting portions in the transport direction and reads a medium transported. According to this aspect, in the image reading apparatus, the same effects as the effects of each aspect in the medium transport device can be obtained.

A fourteenth aspect of the present disclosure is the image reading apparatus according to the thirteenth aspect, further including a separation unit that separates one sheet of a medium from the medium that is double-fed, and a medium thickness detection unit located between the separation unit and the reading unit in the transport direction. According to this aspect, since the medium that is separated by the separation unit is read by the medium thickness detection unit, the reading accuracy improves, and the projecting portions can be effectively operated.

A fifteenth aspect of the present disclosure is the image reading apparatus according to the thirteenth aspect, the apparatus configured to be coupled to an external terminal, the apparatus further including a control unit that is configured to control a plurality of reading modes corresponding to types of the medium, in which the control unit notifies the external terminal of a specific reading mode, among the plurality of reading modes, corresponding to a state in which the projecting portions are located according to a type of the medium, and the specific reading mode is displayed on a display screen of the external terminal. Note that this aspect can also be made dependent on the fourteenth aspect.

According to this aspect, the control unit notifies the external terminal of a specific reading mode, among the plurality of reading modes, corresponding to a state in which the projecting portions are located according to a type of the medium, and the specific reading mode is displayed on a display screen of the external terminal. As a result, the user operability can be improved.

Embodiments

Hereinafter, embodiments of a medium transport device according to the present disclosure and an image reading apparatus including the medium transport device will be specifically described based on the drawings. In the following description, three axes orthogonal to each other are an X-axis, a Y-axis, and a Z-axis, as illustrated in each figure. Directions indicated by arrows of the three axes (X, Y, and Z) are positive directions of the respective directions, and reverse directions thereof are negative directions. The Z-axis direction corresponds to a vertical direction, that is, a gravity acting direction, a +Z direction indicates vertically upward, and a −Z direction indicates vertically downward. The X-axis direction and the Y-axis direction correspond to horizontal directions. A +Y direction indicates a front direction of the device, and a −Y direction indicates a rear direction of the device. A +X direction indicates a right direction of the device, and a −X direction indicates a left direction of the device.

Embodiment 1

Image Reading Apparatus

An image reading apparatus 1 of the present embodiment is a scanner capable of reading an image of a medium. Here, the image means an image visually recorded in the medium, and is, for example, text, graphics, drawings, pictures, and photographs. The medium is not limited to a sheet, and includes a card, a booklet, and the like. As illustrated in FIG. 1, the image reading apparatus 1 includes reading units 51 and 52 that read an image of a medium 3, a first transport roller 4 that transports the medium 3 in a transport direction F along a transport path 2 and is provided upstream of the reading unit 51 in the transport direction F, a second transport roller 6 provided upstream of the reading unit 52, which is another reading unit, located downstream of the reading unit 51, and a third transport roller 8 provided downstream of the reading unit 52. A pair of a feeding roller 10 and a separation roller 7 is disposed upstream of the first transport roller 4 in the transport direction F. The separation roller 7 functions as a separation unit that separates one sheet of a medium from the medium double-fed and transports the sheet. Specifically, rotation torque is applied to the separation roller 7 by a torque limiter (not illustrated), and double feeding of the medium 3 is suppressed. Note that a separation pad may be adopted in place of the separation roller 7. The feeding roller 10 and the separation roller 7 are provided at a central position in a width direction of the medium 3. A pick roller 12 is disposed upstream of the separation roller 7. In the present embodiment, a curving and reversing path 18 is provided downstream of the third transport roller 8. In the curving and reversing path 18, a fourth transport roller 20, a fifth transport roller 22, and a discharge roller 24 are disposed in this order in the transport direction F. The respective rollers are driven by power from a drive source.

In FIG. 1, a medium mounting portion 14 is a portion where the medium 3 to be read is set, and a discharge receiving portion 16 is a portion where the medium 3 that has been read is discharged. The medium mounting portion 14 is configured to move up and down. When the medium 3 set in the medium mounting portion 14 is fed in the transport direction F, first, the medium mounting portion 14 moves upward (+Z direction), and stops in a state in which an uppermost sheet of the medium 3 that is set is in contact with the pick roller 12. When the pick roller 12 is rotated in this state, the medium 3 is fed in the transport direction F, and a leading end of the medium 3 reaches a nip position 26 of the pair of the feeding roller 10 and the separation roller 7.

In the case of a double feeding state in which multiple sheets of the medium 3 are fed, one sheet is separated by the separation roller 7, the one sheet is transported in the transport direction F by the first transport roller 4, and reading of an image on a first surface of the medium 3 is performed in the reading unit 51. Moreover, the medium 3 on which reading has been performed in the reading unit 51 is transported by the second transport roller 6, and reading of a second surface on a side opposite the first surface of the medium 3 is performed in the reading unit 52. The medium 3 on which reading has been performed in the reading unit 52 is fed to the curving and reversing path 18 by the third transport roller 8, transported by the fourth transport roller 20 and the fifth transport roller 22, and discharged to the discharge receiving portion 16 by the discharge roller 24. A series of the following operation is controlled and performed by the control unit 71: moving the medium mounting portion 14 upward, starting transporting of the medium 3 by the pick roller 12, separating one sheet from the medium 3 by the feeding roller 10 and the separation roller 7, transporting the sheet further in the transport direction F, reading an image by the reading units 51 and 52, and transporting the sheet further in the transport direction F.

Medium Transport Device

In the present embodiment, the image reading apparatus 1 includes a medium transport device 9. The structure of the medium transport device 9 will be described below based on FIGS. 1 to 8. As illustrated in FIGS. 2 to 4A and 4B, the medium transport device 9 includes a drive source 15, the transport path 2 through which the medium 3 is transported in the transport direction F between a first path surface 11 (FIGS. 4A and 4B) and a second path surface 13 (FIGS. 4A and 4B) located away from the first path surface 11, a plurality of projecting portions 17 that projects from the first path surface 11 and is arranged in a width direction (X-axis direction) intersecting the transport direction F, and a moving portion 19 to which power of the drive source 15 is transmitted and that changes a projecting amount of the projecting portions 17 with respect to the first path surface 11 between the first path surface 11 and the second path surface 13. The projecting portions 17 are disposed between the separation roller 7 and the reading unit 51 in the transport direction F. The separation roller 7 functions as a separation unit that separates one sheet of the medium 3 from the medium 3 that is double-fed. Here, a plurality of holes 21 (FIG. 2) is formed at the first path surface 11, and the respective projecting portions 17 project toward the second path surface 13 from the respective holes 21. In the respective projecting portions 17, a leading end surface 29 that faces the second path surface 13 functions as a guide surface that guides transporting of the medium 3. The drive source 15 is a motor.

Figure 2:
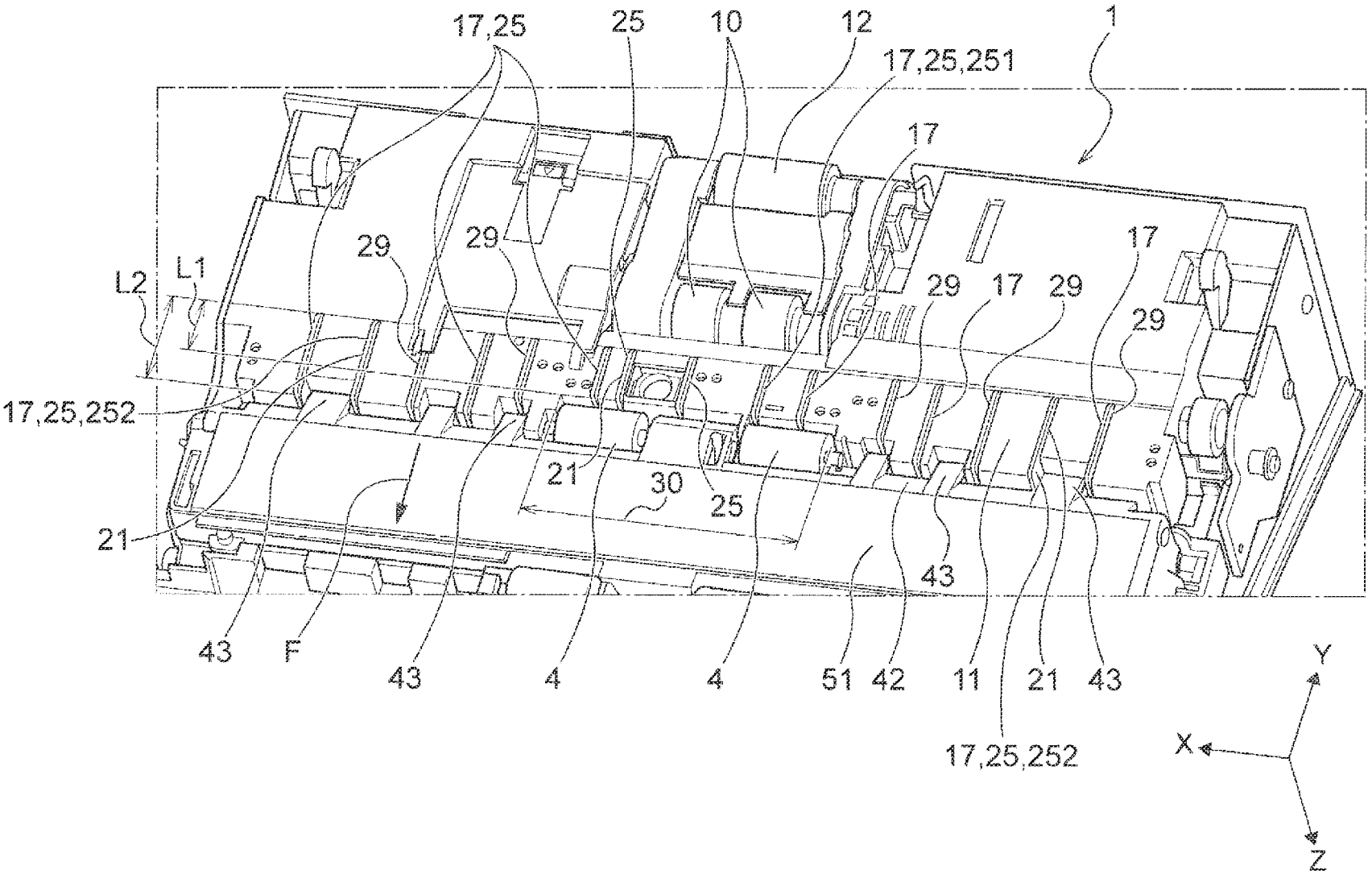
FIG. 2 is a perspective view of a main portion of a medium transport device of Embodiment 1 in an upside-down state.
Figure 3:
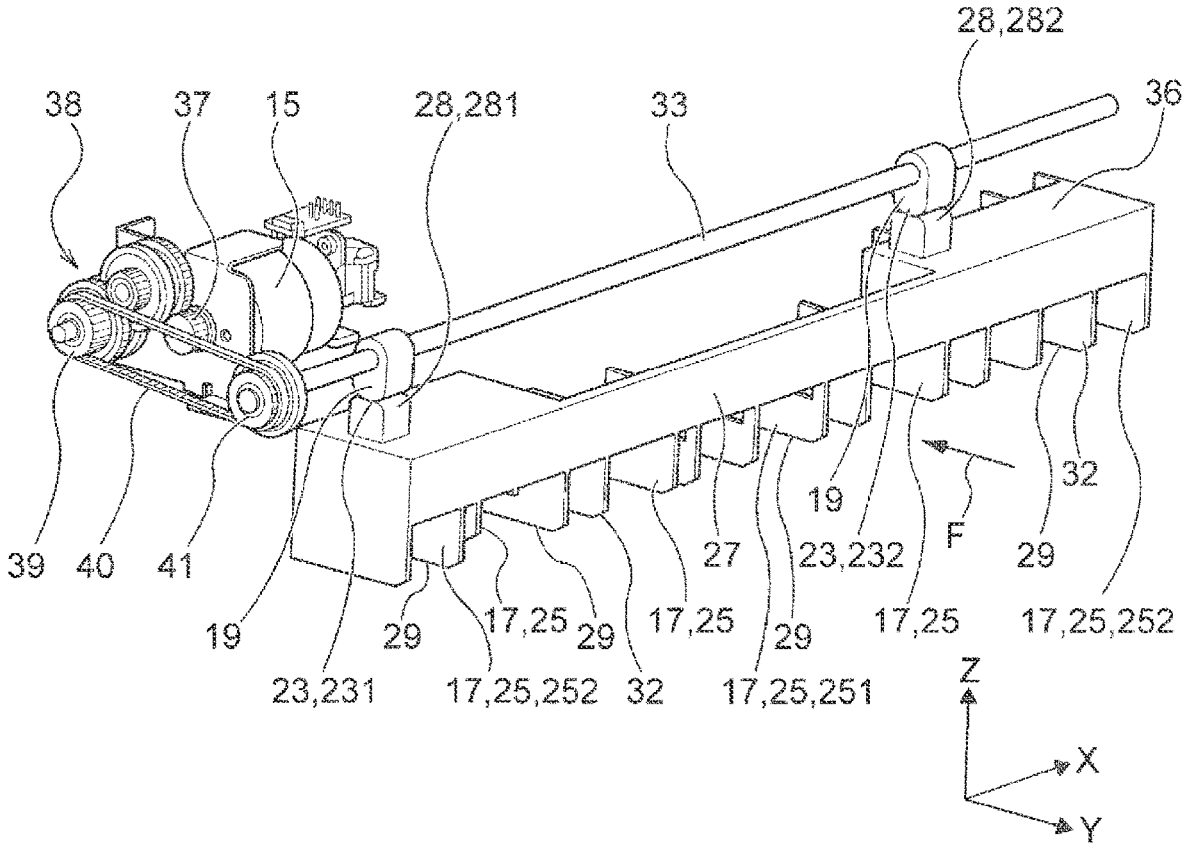
FIG. 3 is a perspective view of a main portion of Embodiment 1.

In the present embodiment, the moving portion 19 includes an abutting portion 23 that can abut against the projecting portions 17. Here, the abutting portion 23 is configured with a cam fixed to a rotation shaft 33, but is not limited to a cam. In addition, as illustrated in FIG. 3, the projecting portions 17 include a plurality of projections 25 provided in the width direction (X-axis direction) intersecting the transport direction F, a supporting portion 27 that supports the projections 25, and an abutted portion 28 against which the abutting portion 23 abuts. In addition, as illustrated in FIG. 3, at least part of the moving portion 19 is disposed so as to overlap the drive source 15 when viewed in the transport direction F. In addition, as illustrated in FIG. 2, the present embodiment includes the transport roller 4 that transports the medium 3, and in a region 30 inside both end portions of the transport roller 4, at least five projections 25 are disposed. Here, five projections 25 are disposed. Six or more projections 25 may be disposed. In addition, the transport roller 4 consists of two transport rollers that are located away from each other in the width direction.

In addition, as illustrated in FIG. 2, in the present embodiment, the projections 25 include a first projection 251 having a first length L1 and a second projection 252 having a second length L2 that is longer than the first length L1 in the transport direction F. In addition, part of the second projection 252 is disposed so as to overlap the transport roller 4 when viewed in a direction of a rotation shaft 31 of the transport roller 4. In addition, as illustrated in FIGS. 4A and 4B, and 5A to 5C, in the present embodiment, each projection 25 has an inclined surface 32 that guides a leading end of the medium 3 in a direction along the transport direction F. In addition, the projection 25 is configured such that when the projection 25 moves further in a direction of increasing the projecting amount, the inclined surface 32 is exposed more.

Figure 5A:
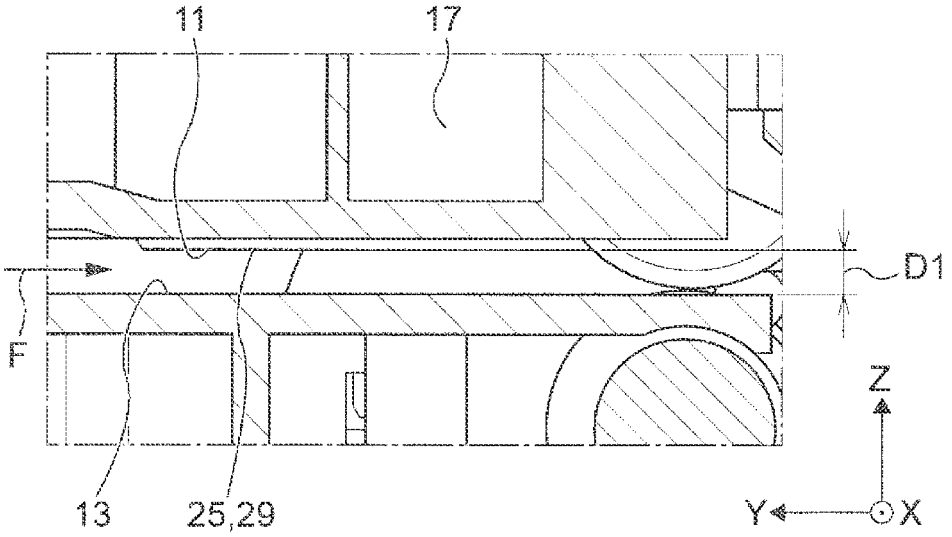
FIGS. 5A to 5C are configuration views of a main portion of Embodiment 1 in a side view.
Figure 5B:
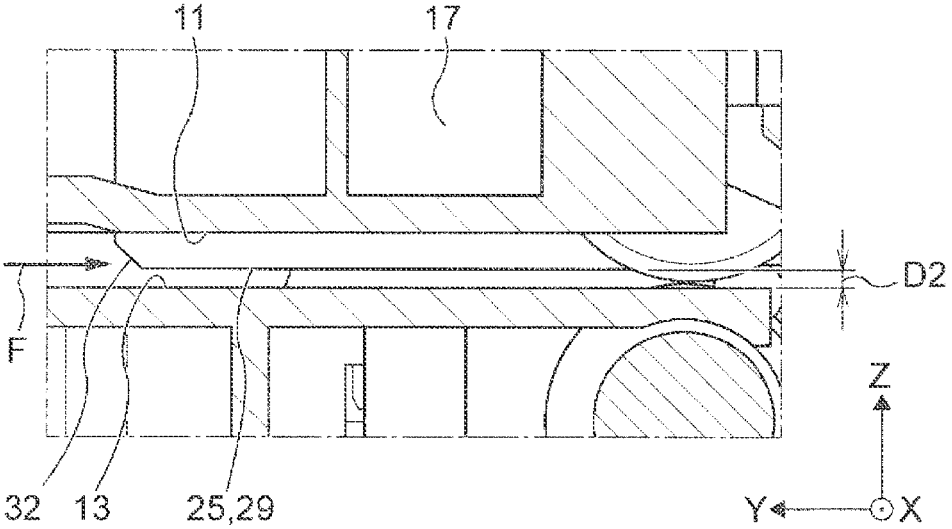
Figure 5C:
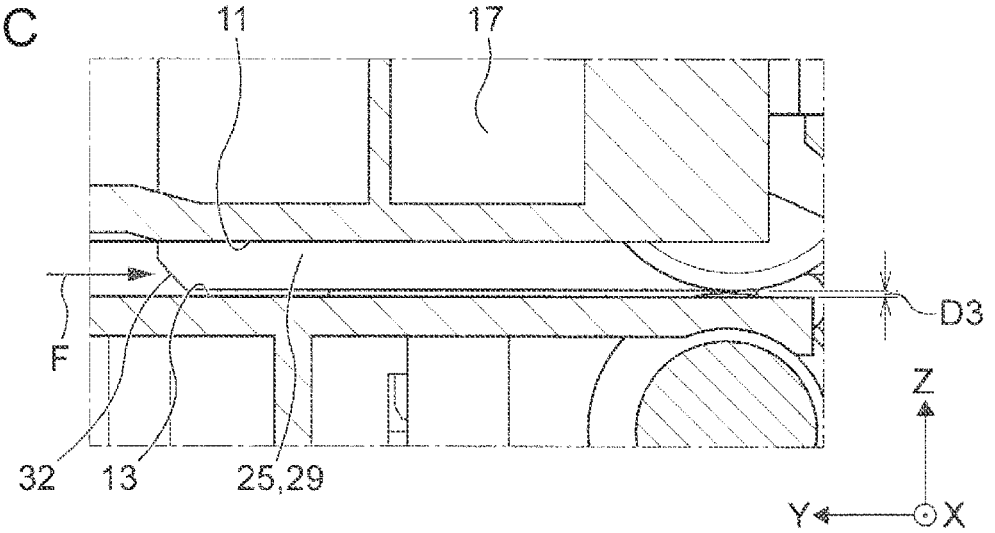

FIG. 5A illustrates a state in which the projecting amount is minimum, and the state corresponds to a case of the medium 3 having large thickness. In this case, a space between the leading end surface 29 of the projection 25 and the second path surface 13 becomes a maximum space D1, and a transport state in a thick paper mode is entered. FIG. 5C illustrates a state in which the projecting amount is maximum, and the state corresponds to a case of the medium 3 having small thickness. In this case, the space between the leading end surface 29 of the projection 25 and the second path surface 13 becomes a minimum space D3, and a transport state in a thin paper mode is entered. FIG. 5B illustrates a state between the minimum and the maximum of the projecting amount. In this case, the space between the leading end surface 29 of the projection 25 and the second path surface 13 becomes a space between maximum and minimum D2, and a transport state in a middle-thickness paper mode is entered.

In addition, as illustrated in FIG. 3, in the present embodiment, the abutting portion 23 includes a first abutting portion 231 and a second abutting portion 232. The abutted portion 28 includes a first abutted portion 281 and a second abutted portion 282. In addition, the first abutting portion 231 and the first abutted portion 281 are provided opposite the second abutting portion 232 and the second abutted portion 282 with respect to a reference position in the width direction. Here, as the reference position, a central position in the width direction of the projecting portions 17 is used. Note that the first abutting portion 231 and the second abutting portion 232 are not required to be symmetrically disposed at an equal distance with respect to the central position, and are sufficient as long as the first abutting portion 231 and the second abutting portion 232 are not disposed while being deviated to one side.

Figure 4A:
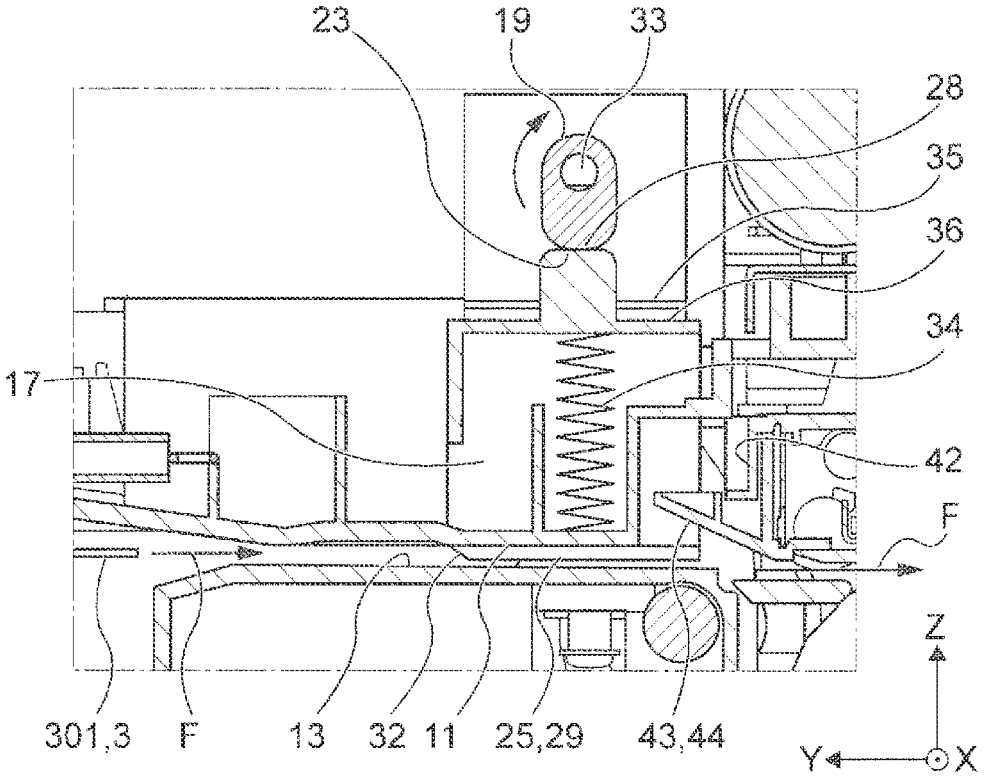
FIGS. 4A and 4B are configuration views of a main portion of Embodiment 1 in a side view.
Figure 4B:
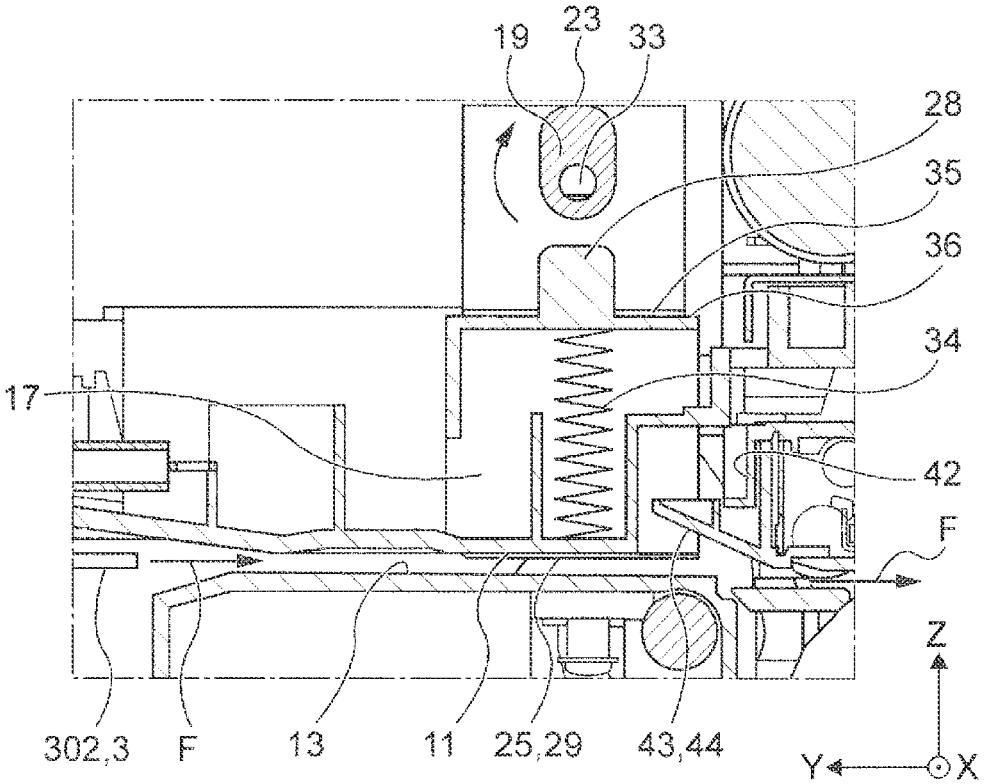

In addition, as illustrated in FIG. 2, in the present embodiment, each projecting portion 17 is configured to be fixed at least at two positions in a projecting direction. Specifically, as illustrated in FIGS. 4A and 4B, in a state in which the abutting portion 23 configured with the cam of the moving portion 19 abuts against and presses the abutted portion 28 serving as a cam follower, the leading end surface 29 of the projecting portion 17 is in a first position in which the leading end surface 29 projects in the projecting direction (FIG. 4A). On the other hand, when the abutting portion 23 is separated from the abutted portion 28, the projecting portion 17 is pressed back by elastic force of a spring 34, and the leading end surface 29 of the projecting portion 17 is in a second position where the leading end surface 29 is further separated from the second path surface 13 than the first position (FIG. 4B). The second position is realized by an upper surface 36 of the projecting portions 17 (FIG. 3) abutting against a stopper 35 with a fixed structure and being stopped (FIGS. 4A and 4B). Note that as illustrated in FIGS. 5A to 5C, as the space between the leading end surface 29 of each projecting portion 17 and the second path surface 13, three positions of the spaces D1, D2, and D3 may be taken. In this case, the structure of the abutting portion 23 as a cam and the abutted portion 28 as a cam follower can be realized through taking of three positions of the space D1, the space D2, and the space D3. Four or more positions of a space may be further taken.

In the present embodiment, as illustrated in FIGS. 2, and 4A and 4B, in the transport direction F, a portion upstream of a holder 42 of the reading unit 51 is provided with a plurality of protrusions 43 that protrudes toward upstream. In addition, as illustrated in FIGS. 4A and 4B, a portion of each protrusion 43 facing the second path surface 13 is formed into an inclined surface 44. By the inclined surface 44, a leading end of the medium 3 that is transported is guided to move in the transport direction F.

Driving of Moving Portion

The moving portion 19 is driven when power is transmitted from the drive source 15. That is, the abutting portion 23 as a cam is rotationally driven as illustrated in FIGS. 4A and 4B, and the projecting amount of the projecting portion 17 is changed by the rotational driving. Specifically, as illustrated in FIG. 3, power is transmitted from a motor pinion 37 of the drive source 15 through a gear train 38, and a first gear 39 is rotated. The rotation of the first gear 39 is transmitted to a second gear 41 by a transmission belt 40. When the second gear 41 is rotated, the rotation shaft 33 is integrally rotated around an axis, thereby rotating the abutting portion 23.

Explanation of Operation of Embodiment 1

When Thin Paper Having Small Thickness of Medium or the Like is Transported

When thin paper having small thickness of the medium 3 or the like is transported, the control unit 71 receives information on the thin paper and rotates the moving portion 19 so as to move the moving portion 19 to the position indicated in FIG. 4A and stop the moving portion 19. As a result, transporting in the thin paper mode is performed.

When Thick Paper Having Large Thickness of Medium or the Like is Transported

When thick paper having large thickness of the medium 3 or the like is transported, the control unit 71 receives information on the thick paper and rotates the moving portion 19 so as to move the moving portion 19 to the position indicated in FIG. 4B and stop the moving portion 19. As a result, transporting in the thick paper mode is performed.

Explanation of Effects of Embodiment 1

1. In the present embodiment, the plurality of projecting portions 17 projects from the first path surface 11 and is disposed so as to be arranged in the width direction (X-axis direction) intersecting the transport direction F. Each of the plurality of projecting portions 17 can change the projecting amount with respect to the first path surface 11 by the moving portion 19. As a result, even for the medium 3 having a different thickness, when the projecting amount is adjusted such that the thin paper mode or the thick paper mode is entered according to the thickness, the medium 3 can be stably transported.
2. In addition, in the present embodiment, the projecting portions 17 are fixed at least at two positions in the projecting direction. In other words, the projecting portions 17 take two positions, which are the first position (the state in FIG. 4A) and the second position (the state in FIG. 4B) in the projecting direction, and are configured to be rigidly fixed, not by a balanced state of elastic force. As a result, the medium 3 having a different thickness can be stably transported.
3. In addition, in the present embodiment, the moving portion 19 includes the abutting portion 23 having a cam structure, and the projecting portions 17 include the plurality of projections 25, the supporting portion 27 that supports the projections 25, and the abutted portion 28 against which the abutting portion 23 abuts. As a result, with a simple structure, the projecting portions 17 can take the first position and the second position. In addition, since at least part of the moving portion 19 overlaps the drive source 15 when viewed in the transport direction F, an increase in size in a height direction (Z-axis direction) of the device can be suppressed.
4. In addition, in the present embodiment, in the region 30 inside both end portions of the transport roller 4 that transports the medium 3, at least five projections 25 are disposed. As a result, even the medium 3 having minimum width size that can be transported such as a business form, a plastic card, and a business card can be stably transported. As a result, in the present embodiment, a so-called center paper feeding structure in which the medium 3 is transported while the center of the medium 3 is aligned with a central region in the width direction is configured.

5. In addition, in the present embodiment, the projections 25 includes the first projection 251 having the first length L1, in the transport direction F, and the second projection 252 having the second length L2 that is longer than the first length L1, and part of the second projection 252 overlaps the transport roller 4 when viewed in the rotation axis direction of the transport roller 4. As a result, an increase in size of the entire device in the transport direction F can be suppressed.
6. In addition, in the present embodiment, the respective projections 25 include the inclined surface 32 that guides a leading end of the medium 3 at an upstream position of the leading end surface 29, in the transport direction F, facing the second path surface 13, and when the projections 25 move further in a direction of increasing the projecting amount, the inclined surface 32 is exposed more. As a result, since the inclined surface 32 can guide the leading end of the medium 3 having a different thickness in the same manner, transporting performance of the medium 3 can be stabilized.
7. In addition, in the present embodiment, the first abutting portion 231 and the first abutted portion 281 are disposed opposite the second abutting portion 232 and the second abutted portion 282 with respect to the reference position in the width direction. As a result, the entire projecting portions 17 can be stably moved.

Embodiment 2

Next, the medium transport device 9 according to Embodiment 2 will be described. The same components as Embodiment 1 will be denoted by the same reference numerals, and the configurations thereof and corresponding effects will be omitted. As illustrated in FIG. 1, the present embodiment includes a first path 45 having a straight shape that transports the medium 3 which has been read by the reading units 51 and 52 in a transport direction without curving and reversing the medium 3, a second path 46 having a curved shape or a U-turn shape that curves, reverses, and transports a medium which has been read in a transport direction, and the switching unit 47 that is switched between the first path 45 and the second path 46. As illustrated in FIG. 4A, when the respective projecting portions 17 are at a position of transporting a first medium 301 such as regular paper, the switching unit 47 is in a position where the first medium 301 can be transported through the second path 46. On the other hand, as illustrated in FIG. 4B, when the respective projecting portions 17 are at a position of transporting a second medium 302 such as thick paper and a booklet thicker than the first medium 301, the switching unit 47 is in a position where the second medium 302 can be transported through the first path 45.

Figure 6:
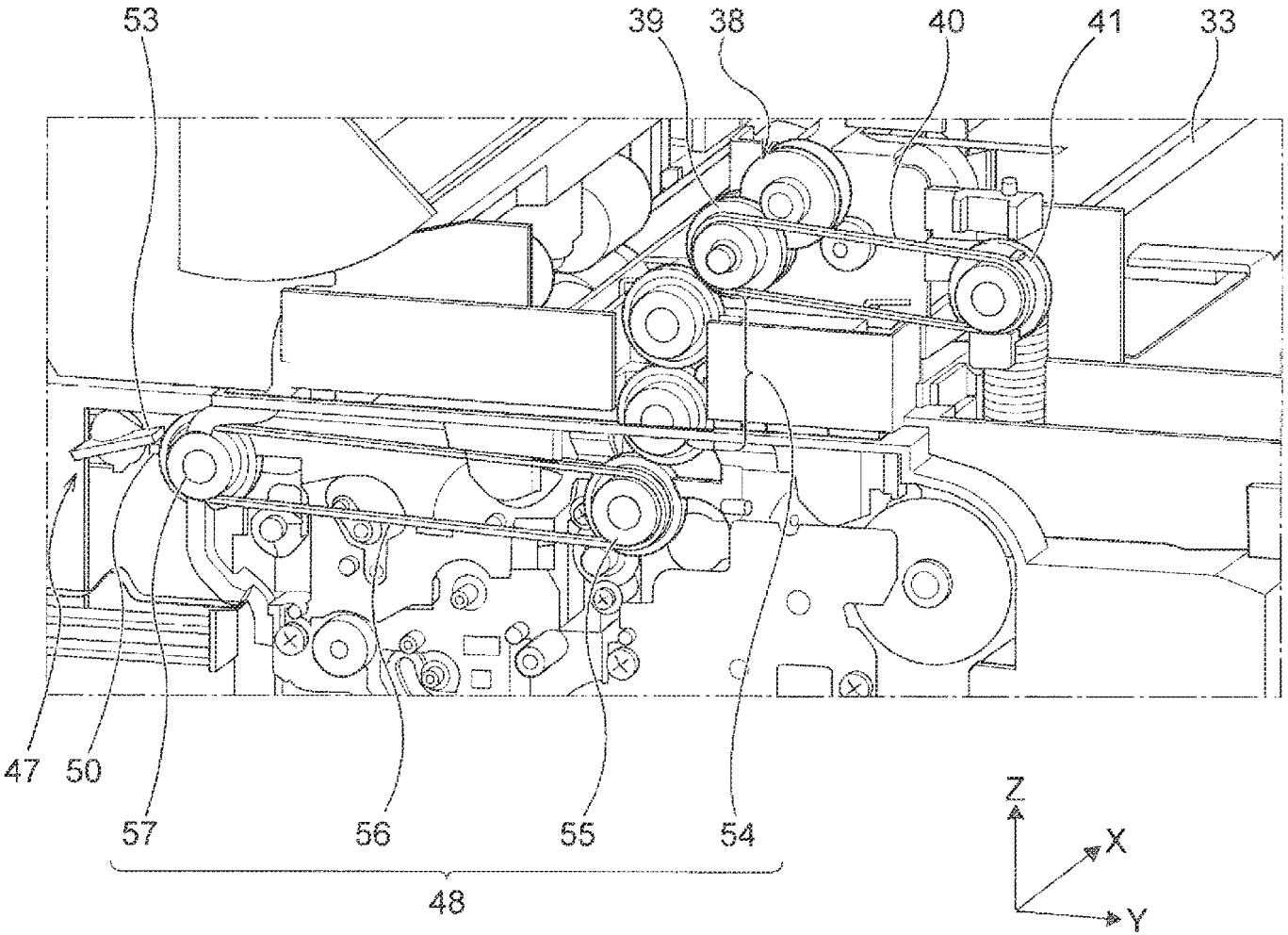
FIG. 6 is a perspective view of a main portion of Embodiment 2.
Figure 7A:
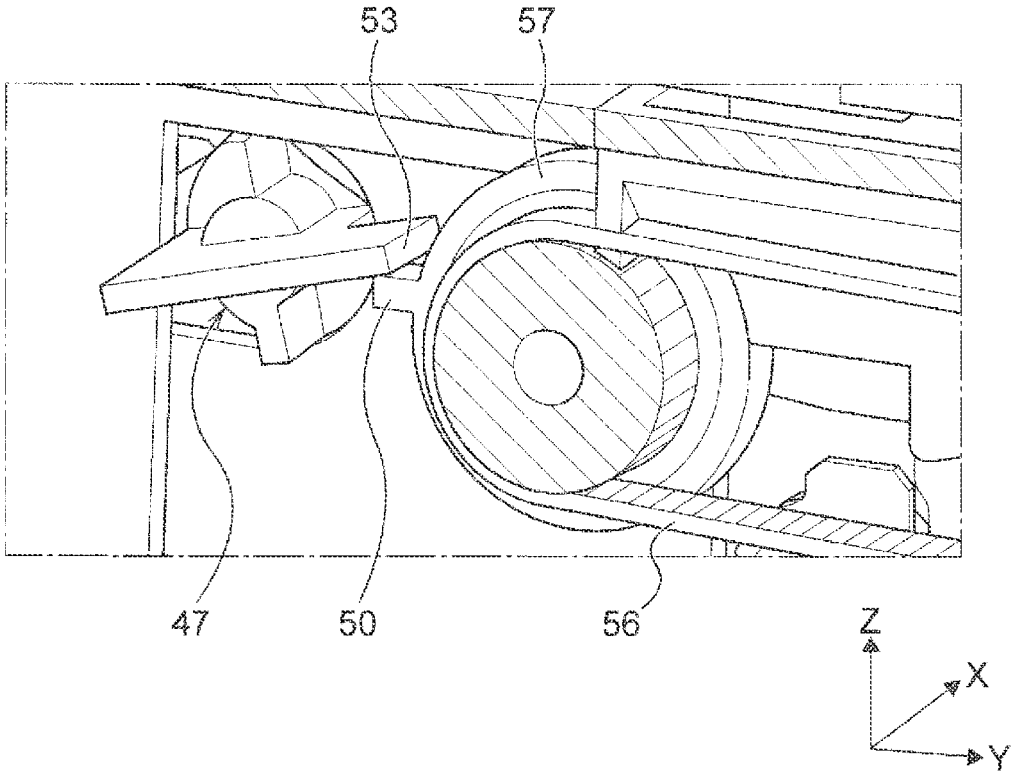
FIGS. 7A and 7B are enlarged perspective views of a main portion of Embodiment 2.
Figure 7B:
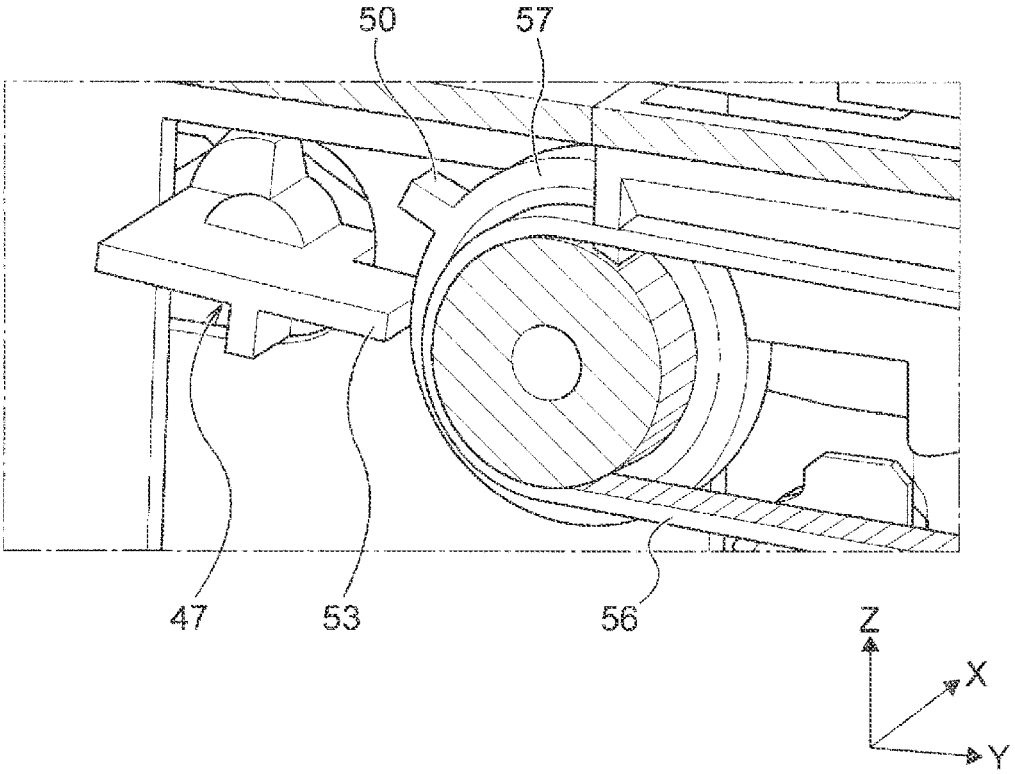
Figure 8:
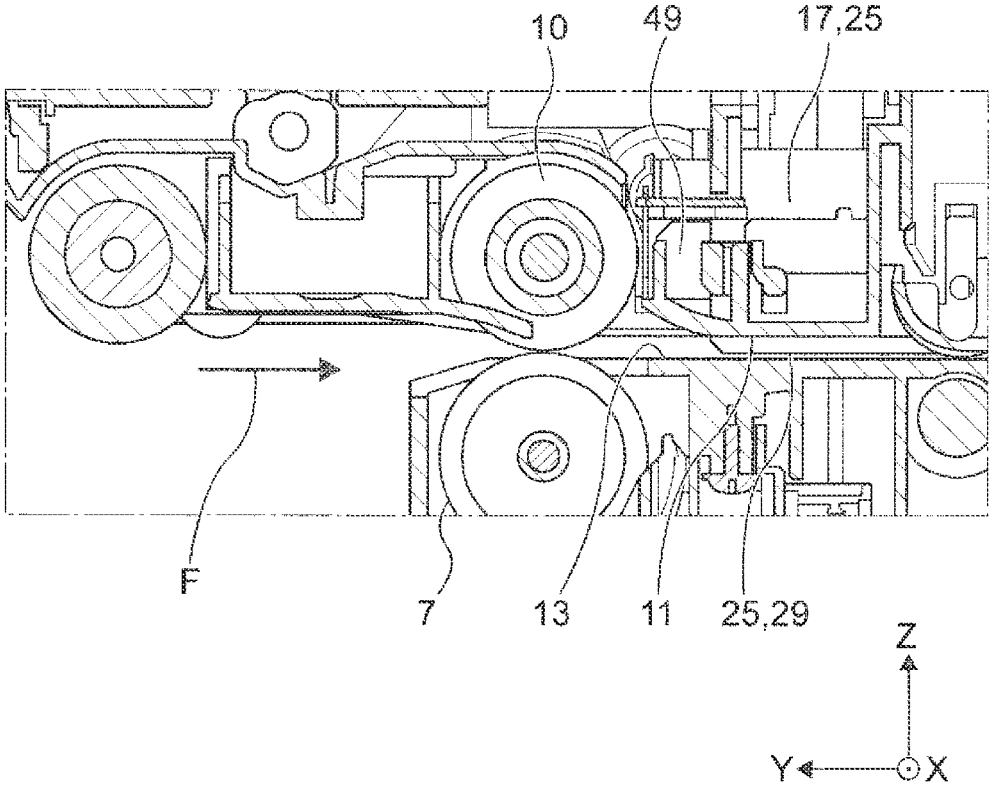
FIG. 8 is a configuration view of a main portion of Embodiment 2 in a side view.

In addition, as illustrated in FIG. 6, the present embodiment includes a power transmission unit 48 that transmits power of the drive source 15 to the switching unit 47. The power transmission unit 48 transmits power such that when the drive source 15 rotates in one direction, for example, in the case of normal rotation, the respective projecting portions 17 move to a position of transporting the first medium 301, and at the same time, the switching unit 47 is switched to a position where the first medium 301 can be transported through the second path 46. On the other hand, the power transmission unit 48 transmits power such that when the drive source 15 rotates in the other direction, for example, in the case of reverse rotation, the respective projecting portions 17 move to a position of transporting the second medium 302, and at the same time, the switching unit 47 is switched to a position where the second medium 302 can be transported through the first path 45. Here, the power transmission unit 48 is configured such that when the drive source 15 rotates in one direction by "a fixed quantity", the respective projecting portions 17 move to the position of transporting the first medium 301 and stop, and the switching unit 47 stops in a state in which the switching unit 47 is switched to the position where the first medium 301 can be transported through the second path 46. In the same manner, the power transmission unit 48 is configured such that when the drive source 15 rotates in the other direction by "a fixed quantity", the respective projecting portions 17 move to the position of transporting the second medium 302 and stop, and the switching unit 47 stops in a state in which the switching unit 47 is switched to the a position where the second medium 302 can be transported through the first path 45. The power transmission unit 48 includes a gear train 54 to which power is transmitted from the first gear 39, a third gear 55 to which power is transmitted from the gear train 54, and a switching gear 57 to which power is transmitted from the third gear 55 through a transmission belt 56.

In addition, the present embodiment includes the switching gear 57 disposed at a position, in the power transmission unit 48, of transmitting power to the switching unit 47, a pressing portion 50 that is a projection provided in the switching gear 57, and a pressed portion 53 that is a projection provided in the switching unit 47. In addition, at normal time, the switching unit 47 is in the position where the first medium 301 can be transported through the second path 46. In addition, when the second medium 302 is transported, the switching unit 47 is configured to be switched to the position where the second medium 302 can be transported through the first path 45 after the power is transmitted to rotate the switching gear 57, and the pressed portion 53 is pressed by the pressing portion 50 and rotates.

In addition, the present embodiment includes a medium thickness detection unit 49 located between the separation roller 7 serving as a separation unit that separates one sheet of the medium 3 from the medium 3 that is double-fed and the switching unit 47 in the transport direction F. The medium thickness detection unit 49 detects information on the thickness of the medium 3 separated by the separation roller 7. Here, an ultrasonic sensor is used as the medium thickness detection unit 49. In addition, in the present embodiment, as illustrated in FIG. 1, the medium thickness detection unit 49 is disposed between the separation roller 7 and the reading unit 51 in the transport direction F, but may be disposed at a different position. In addition, when a detection result of the medium thickness detection unit 49 is equal to or more than a threshold, the switching unit 47 is configured to be switched to a position where the medium 3 can be transported through the first path 45, and when the detection result of medium thickness detection unit 49 is less than the threshold, the switching unit 47 is configured to be switched to a position where the medium 3 can be transported through the second path 46. The threshold is set such that it can be determined that the medium 3 is a medium whose thickness belongs to thick paper or the like, or a medium whose thickness belongs to regular paper or the like. In the present embodiment, in the switching operation of the switching unit 47, upon receiving the detection result of the medium thickness detection unit 49, the control unit 71 determines that the thickness of the medium 3, which is the detection result, is equal to or more than the threshold, or is less than the threshold. That is, the control unit 71 is configured to determine the medium 3 that is transported is a medium that belongs to thick paper or the like or a medium that belongs to regular paper or the like, and based on the determination, drive and switch the switching unit 47.

Figure 10:
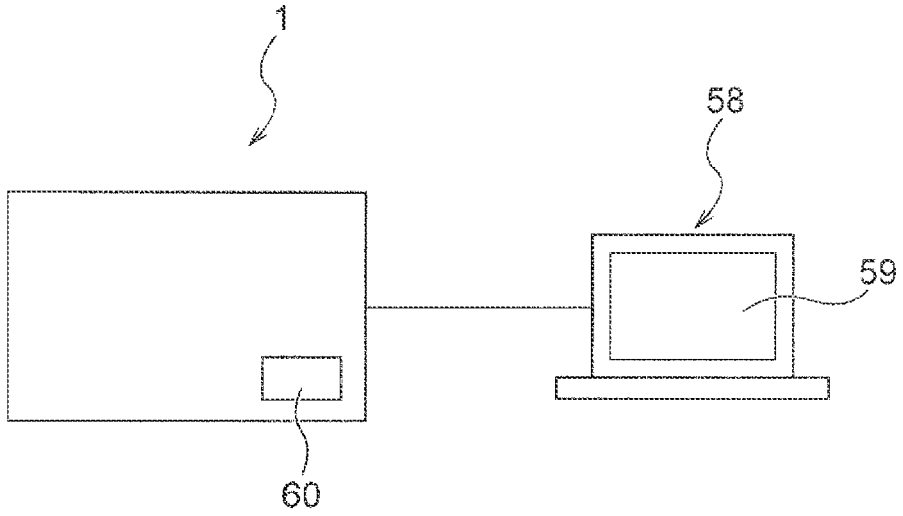
FIG. 10 is a schematic configuration view of Embodiment 2.

As illustrated in FIG. 10, a personal computer 58 as an external terminal and the image reading apparatus 1 are coupled, and there is a type of the image reading apparatus 1 that is implemented by setting the reading operation of the image reading apparatus 1 through inputting or selecting "automatically detect the type of medium by the medium thickness detection unit", "set the type of medium not automatically but by the user", or information on other conditions while an display screen 59 of the personal computer 58 is viewed. In the present embodiment, in the image reading apparatus 1 of this type, the control unit 71 implements the reading operation based on the information input from the display screen 59. The display screen 59 is configured to display "automatic detection", "user setting" or the like as a display related to "automatically detect the type of medium by the medium thickness detection unit", or "set the type of medium not automatically but by the user".

When the user selects "automatic detection", in a case in which the detection result of the medium thickness detection unit 49 is "thick paper", the information is sent to the control unit 71, and the control unit 71 determines that the transport path to be adopted is "the first path 45 for thick paper". In addition, the control unit 71 switches the switching unit 47 such that the transport path becomes the first path 45 for thick paper, and at the same time, sends to the personal computer 58 the result of the determination, that is, the information on the "reading mode" indicating "the first path 45 for thick paper". As a result, the display screen 59 of the personal computer 58 displays the reading mode corresponding to the first path 45 for thick paper such as "thick paper mode", "straight path mode", or the like, and the user operability is improved. When the detection result of the medium thickness detection unit 49 is "regular paper", the control unit 71 switches the switching unit 47 such that the transport path becomes the second path 46 for regular paper, and at the same time, sends the result of the determination to the personal computer 58, and the display screen 59 displays the reading mode such as "regular paper mode", "reversing path mode", or the like. Note that in FIG. 10, a display panel 60 is a display panel of the image reading apparatus 1. The reading mode may be displayed on the display panel 60.

Automation of Switching of Transport Path by Medium Thickness Detection Unit

Figure 9:
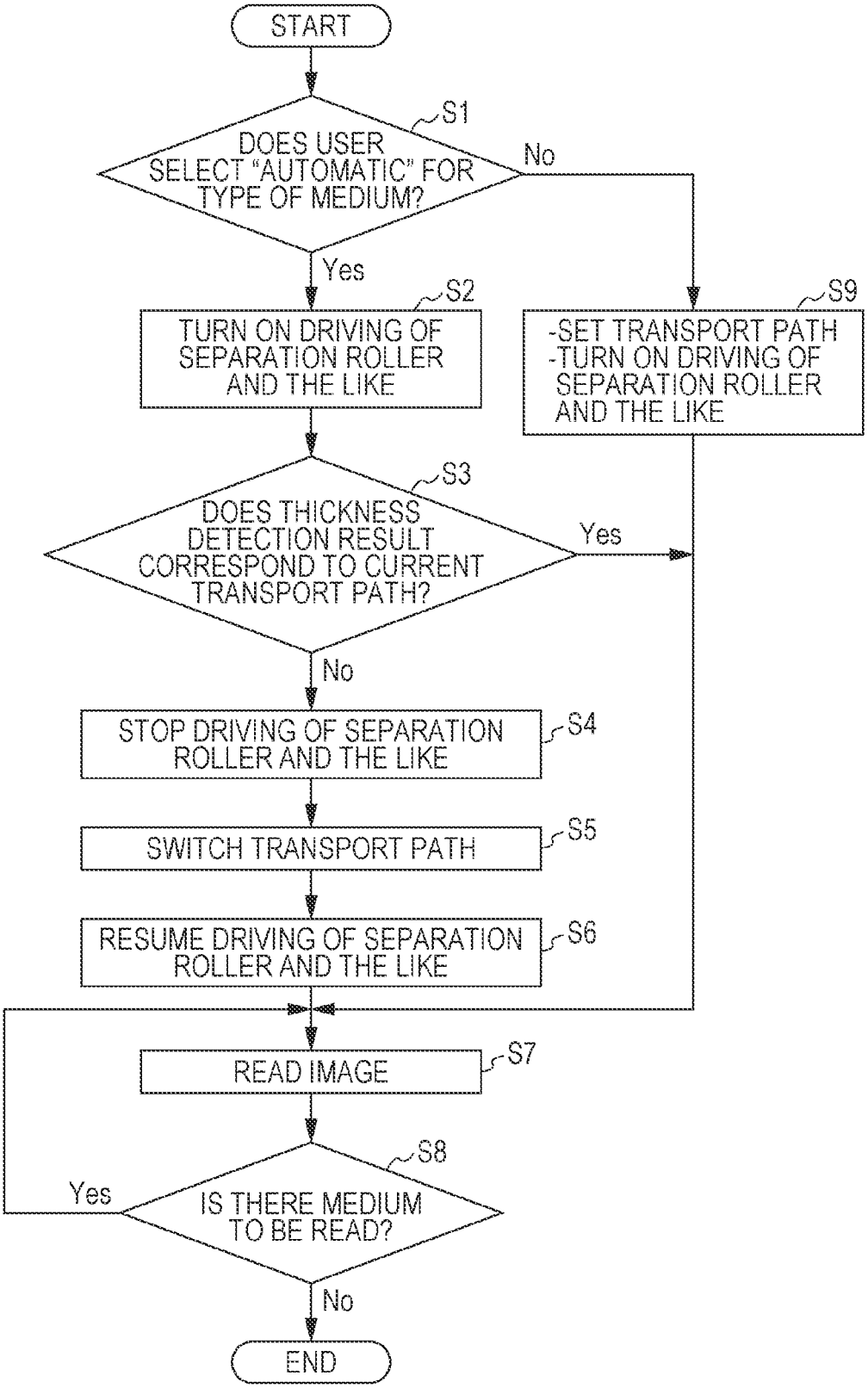
FIG. 9 is a flowchart of Embodiment 2.

By the flowchart of FIG. 9, a configuration in which the control unit 71 automates switching of the transport path by the medium thickness detection unit 49 and an example of control procedures thereof will be described. First, in step S1, it is determined whether the user selects "automatic" for specifying the type of the medium 3, that is, the types of regular paper, thick paper, and the like while viewing the display screen 59 of the personal computer 58. In the case of Yes, the process advances to step S2, and driving of the separation roller 7 and the like is turned on to start transporting the medium 3. When the leading end of the medium 3 to be transported reaches a detection position of the medium thickness detection unit 49, the thickness of the medium 3 is detected, and in step S3, it is determined whether the result of the detection corresponds to the current transport path. In the case of No, the process advances to step S4. In step S4, driving of the separation roller 7 and the like is stopped, and the transporting is stopped. Subsequently, in step S5, the switching unit 47 switches the transport path to make the transport path corresponding to the detection result. Subsequently, the process advances to step S6, driving of the separation roller 7 is turned on to resume the transporting, and in step S7, the reading units 51 and 52 read an image. Subsequently, in step S8, it is determined whether or not the medium 3 to be read still remains, and when such a medium 3 remains, that is, in the case of Yes, the process returns to step S2. On the other hand, in the case of No, the process ends. In the case of No in step S1, the process advances to step S9. In step S9, the transport path is set, driving of the separation roller 7 and the like is turned on to transport the medium 3, and the process advances to step S7. In the case of Yes in step S3, the process advances to step S7.

Explanation of Effects of Embodiment 2

1. In the present embodiment, when the respective projecting portions 17 are at a position of transporting the first medium 301, the switching unit 47 is switched to a position where the first medium 301 can be transported through the second path 46, and when the respective projecting portions 17 are at a position of transporting the second medium 302 thicker than the first medium 301, the switching unit 47 is switched to a position where the second medium 302 can be transported through the first path 45. As a result, since the transport path can be switched according to the difference in thickness of the medium 3, transport damage to the medium 3 can be suppressed.
2. In addition, in the present embodiment, when power is transmitted from the drive source 15 through the power transmission unit 48, and the drive source 15 rotates in one direction, the respective projecting portions 17 move to a position of transporting the first medium 301, and the switching unit 47 is switched to the position where the first medium 301 can be transported through the second path 46. In addition, when the drive source 15 rotates in the other direction, the respective projecting portions 17 move to a position of transporting the second medium 302, and the switching unit 47 is switched to the position where the second medium 302 can be transported through the first path 45. As a result, since operation of the projecting portions 17 and operation of the switching unit 47 can be performed while a motor as the drive source 15 is not increased, size reduction can be realized.
3. In addition, in the present embodiment, at normal time, the switching unit 47 is in the position where the first medium 301 can be transported through the second path 46. In addition, when the second medium 302 is transported, the switching unit 47 is switched to the position where the second medium 302 can be transported through the first path 45 after the power is transmitted to rotate the switching gear 57, and the pressed portion 53 is pressed by the pressing portion 50 and rotates. As a result, operation of the projecting portions 17 and operation of the switching unit 47 can be performed with a simple structure.
4. In addition, in the present embodiment, when a detection result of the medium thickness detection unit 49 is equal to or more than a threshold, the switching unit 47 is switched to the position where the medium 3 can be transported through the first path 45, and when the detection result of the medium thickness detection unit 49 is less than the threshold, the switching unit 47 is switched to the position where the medium 3 can be transported through the second path 46. As a result, the transport path can be automatically switched according to the thickness of the medium 3.

5. In addition, in the present embodiment, when "automatic" is selected as a type of the medium 3, in a case in which a detection result of the medium thickness detection unit 49 does not correspond to the transport path, the control unit 71 stops transporting of the medium 3, and resumes transporting after the transport path is switched. As a result, since the transport path can be automatically changed, user convenience is enhanced.

6. In addition, in the present embodiment, among the plurality of reading modes, a reading mode corresponding to a state in which the projecting portions 17 are located according to a type of the medium 3 is displayed on the display screen 59. As a result, the user operability can be improved.

Other Embodiments

The medium transport device 9 according to the present disclosure and the image reading apparatus 1 including the medium transport device 9 basically have the configurations of the above-described embodiments, but it is naturally possible to, for example, change and omit partial configurations without departing from the spirit of the present disclosure. In the above-described embodiments, a case in which the first path surface 11 is an upper-side path surface, and the second path surface 13 is a lower-side path surface has been described, but the configuration is not limited thereto, and may have a reverse arrangement.

What is claimed is:

1. A medium transport device comprising:

a drive source;

a transport path through which a medium is transported in a transport direction between a first path surface and a second path surface located away from the first path surface;

a plurality of projecting portions that projects from the first path surface and is arranged in a width direction intersecting the transport direction; and a moving portion that receives power transmitted from the drive source and that changes a projecting amount of the projecting portions with respect to the first path surface between the first path surface and the second path surface, wherein the moving portion includes an abutting portion configured to abut against the projecting portions, the projecting portions include a plurality of projections provided in a width direction intersecting the transport direction, a supporting portion that supports the projections, and an abutted portion against which the abutting portion abuts, and at least part of the moving portion overlaps the drive source when viewed in the transport direction.

2. The medium transport device according to claim 1, wherein the projecting portions are fixed at least at two positions in a projecting direction.

3. The medium transport device according to claim 1, further comprising:

a transport roller that transports the medium, wherein the transport roller has a region where at least five projections are disposed, the region being inside both end portions of the transport roller.

4. The medium transport device according to claim 1, further comprising:

a transport roller that transports the medium, wherein the projections include a first projection having a first length in the transport direction, and a second projection having a second length longer than the first length, and part of the second projection overlaps the transport roller when viewed in a rotation axis direction of the transport roller.

5. The medium transport device according to claim 1, wherein the respective projections include an inclined surface that guides a leading end of the medium at an upstream position of a leading end surface in the transport direction, the leading end surface facing the second path surface, and when the projections are moved further in a direction of increasing the projecting amount, the inclined surface is exposed more.

6. The medium transport device according to claim 1, wherein the abutting portion includes a first abutting portion and a second abutting portion, the abutted portion includes a first abutted portion and a second abutted portion, an the first abutting portion and the first abutted portion are provided opposite the second abutting portion and the second abutted portion with respect to a reference position in the width direction.

7. An image reading apparatus, comprising:

the medium transport device according to claim 1; and a reading unit that is located downstream of the projecting portions in the transport direction and reads a medium transported.

8. The image reading apparatus according to claim 7, further comprising:

a separation unit that separates one sheet of a medium from the medium that is double-fed; and a medium thickness detection unit located between the separation unit and the reading unit in the transport direction.

9. The image reading apparatus according to claim 7, the apparatus configured to be coupled to an external terminal, the apparatus further comprising:

a control unit configured to control a plurality of reading modes corresponding to types of the medium, wherein the control unit notifies the external terminal of a specific reading mode, among the plurality of reading modes, corresponding to a state in which the projecting portions are located according to a type of the medium, and the specific reading mode is displayed on a display screen of the external terminal.

10. A medium transport device according to claim 1, wherein the respective projecting portions are configured to be displaceable between a first position for transporting a first medium and a second position for transporting a second medium having a thickness greater than that of the first medium, and when the respective projecting portions are in the first position, an amount by which the respective projecting portions protrude from the first path surface is greater than an amount by which the respective projecting portions protrude from the first path surface when the protrusion is in the second position.

11. A medium transport device comprising:

a drive source;

a transport path through which a medium is transported in a transport direction between a first path surface and a second path surface located away from the first path surface;

a plurality of projecting portions that projects from the first path surface and is arranged in a width direction intersecting the transport direction;

a moving portion that receives power transmitted from the drive source and that changes a projecting amount of the projecting portions with respect to the first path surface between the first path surface and the second path surface;

a first path through which the medium is transported in the transport direction without being curved and reversed;

a second path through which the medium is curved and reversed, and transported in the transport direction; and a switching unit that switches between the first path and the second path, wherein the projecting portions are fixed at least at two positions in a projecting direction, when the respective projecting portions are at a position of transporting a first medium, the switching unit is in a position where the first medium is configured to be transported through the second path, and when the respective projecting portions are at a position of transporting a second medium thicker than the first medium, the switching unit is in a position where the second medium is configured to be transported through the first path.

12. The medium transport device according to claim 11, further comprising:

a power transmission unit that transmits power of the drive source to the switching unit, wherein when the drive source rotates in one direction, the respective projecting portions move to the position of transporting the first medium, and the switching unit is switched to the position where the first medium is configured to be transported through the second path, and when the drive source rotates in another direction, the respective projecting portions move to the position of transporting the second medium, and the switching unit is switched to the position where the second medium is configured to be transported through the first path.

13. The medium transport device according to claim 12, further comprising:

a switching gear disposed at a position, in the power transmission unit, of transmitting power to the switching unit;

a pressing portion provided in the switching gear; and a pressed portion provided in the switching unit, wherein at normal time, the switching unit is in the position where the first medium is configured to be transported through the second path, and when the second medium is transported, the switching unit is switched to the position where the second medium is configured to be transported through the first path after the power is transmitted to rotate the switching gear, and the pressed portion is pressed by the pressing portion and rotates.

14. The medium transport device according to claim 11, further comprising:

a separation unit that separates one sheet of a medium from the medium that is double-fed; and a medium thickness detection unit located between the separation unit and the switching unit in the transport direction, wherein the medium thickness detection unit detects information on thickness of the medium separated by the separation unit, when a detection result of the medium thickness detection unit is equal to or more than a threshold, the switching unit is switched to a position where the medium is configured to be transported through the first path, and when the detection result of the medium thickness detection unit is less than the threshold, the switching unit is switched to a position where the medium is configured to be transported through the second path.

15. The medium transport device according to claim 14, further comprising a control unit that controls the drive source, wherein when "automatic" is selected as a type of the medium, in a case in which a detection result of the medium thickness detection unit does not correspond to a transport path, the control unit stops transporting of the medium, and resumes transporting after the transport path is switched.

* * * * *